US007766080B2

(12) United States Patent
Khehra et al.

(10) Patent No.: US 7,766,080 B2
(45) Date of Patent: Aug. 3, 2010

(54) SNUBBING JACK

(75) Inventors: Mehtab S. Khehra, Edmonton (CA); Irvin M. Slager, Tulum (MX)

(73) Assignee: 1128971 Alberta Ltd., Edmonton (CA)

( * ) Notice: Subject to any disclaimer, the term of this patent is extended or adjusted under 35 U.S.C. 154(b) by 0 days.

(21) Appl. No.: 12/168,804

(22) Filed: Jul. 7, 2008

(65) Prior Publication Data

US 2010/0001238 A1 Jan. 7, 2010

(51) Int. Cl.
*E21B 19/00* (2006.01)

(52) U.S. Cl. ..... 166/85.5; 166/77.4

(58) Field of Classification Search ..... 166/383, 166/380, 77.4, 77.51, 85.1, 85.5
See application file for complete search history.

(56) References Cited

U.S. PATENT DOCUMENTS 2,090,854 A 8/1937 Timbs
4,476,936 A * 10/1984 Boyadjieff et al. ..... 166/383
6,412,560 B1 * 7/2002 Bernat ..... 166/301
7,578,352 B2 * 8/2009 Hallonquist et al. ..... 166/383
2001/0000099 A1 * 4/2001 Rogers ..... 16/77.51
2004/0262015 A1 * 12/2004 Mazzella et al. ..... 166/383
2006/0108122 A1 * 5/2006 Buytaert et al. ..... 166/379
2006/0118294 A1 * 6/2006 Haakenson ..... 166/77.52
2006/0254776 A1 * 11/2006 Williams ..... 166/355
2007/0084606 A1 * 4/2007 Ponville ..... 166/355
2008/0053661 A1 * 3/2008 Funk ..... 166/380
2009/0000788 A1 * 1/2009 Olsen et al. ..... 166/355

* cited by examiner

*Primary Examiner*—Daniel P Stephenson
(74) *Attorney, Agent, or Firm*—Christensen O'Connor Johnson Kindness PLLC

(57) ABSTRACT

A snubbing jack includes a first telescopic member and a second telescopic member. A stationary plate and a movable plate are affixed to the telescopic members. The movable plate moves away from the stationary plate upon expansion of the telescopic member and moves toward the stationary plate upon contraction of the telescopic members. An intermediate plate is removably secured between the stationary plate and the movable plate.

3 Claims, 2 Drawing Sheets

SNUBBING JACK

FIELD

There is described a snubbing jack which is used on a well during a process called snubbing.

BACKGROUND

A conventional snubbing jack consists of a pair of hydraulic rams positioned between a stationary plate and a movable plate. Upon expansion of the hydraulic rams, the movable plate moves away from the stationary plate. Upon contraction of the hydraulic rams, the movable plate moves toward the stationary plate.

SUMMARY

There is provided a snubbing jack, comprising a first telescopic member and a second telescopic member. A stationary plate is affixed to the telescopic members. A movable plate is affixed to the telescopic members. The movable plate moves away from the stationary plate upon expansion of the telescopic member and moves toward the stationary plate upon contraction of the telescopic members. An intermediate plate is secured between the stationary plate and the movable plate.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 3:
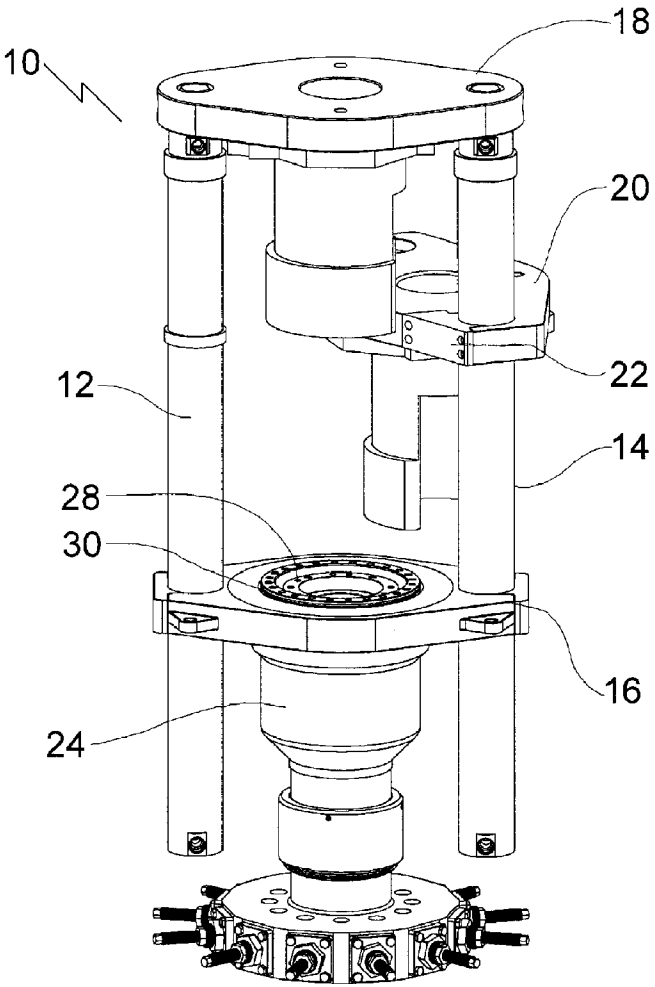
FIG. 3 is a front perspective view of the snubbing jack of FIG. 1 with the intermediate plate withdrawn and the cap removed.

A snubbing jack generally identified by reference numeral 10, will now be described with reference to FIGS. 1 through 3.

Figure 1:
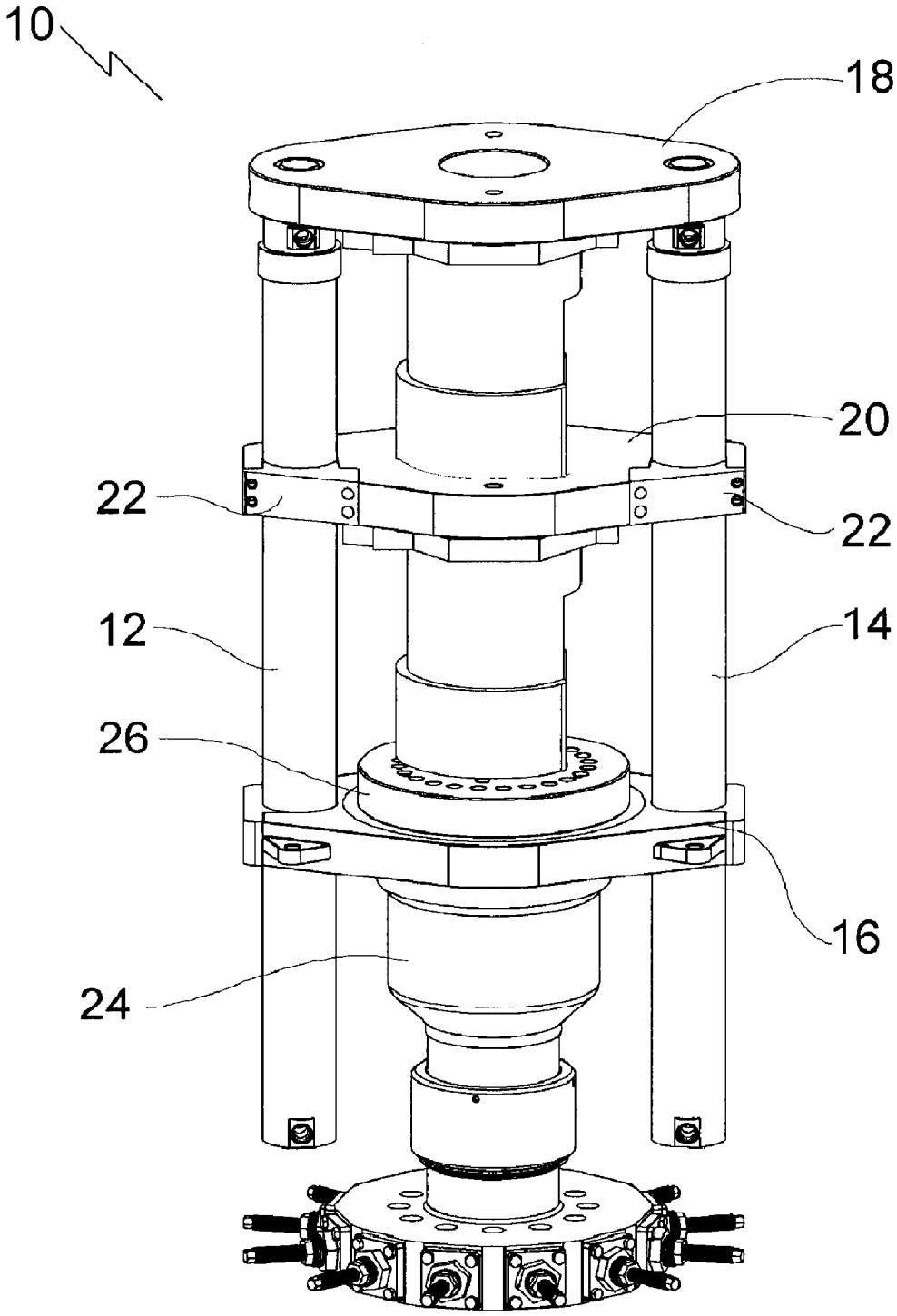
FIG. 1 is a front perspective view of a snubbing jack.
Figure 2:
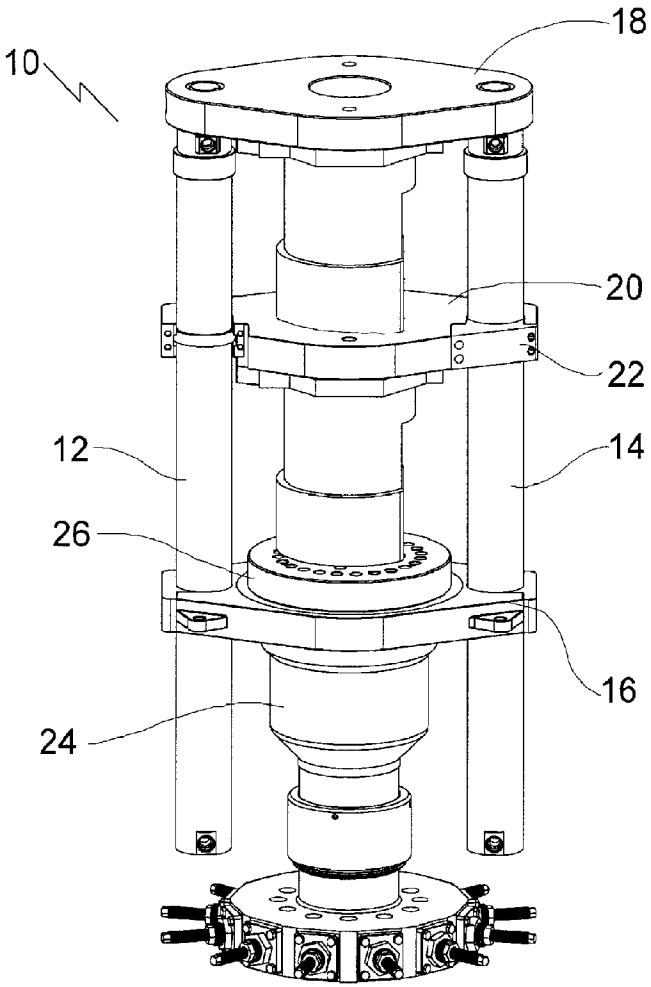
FIG. 2 is a front perspective view of the snubbing jack of FIG. 1 with a clamp removed.

Structure and Relationship of Parts:

Referring to FIG. 1, snubbing jack 10 has a first telescopic member 12 and a second telescopic member 14. A stationary plate 16 and a movable plate are affixed to telescopic members 12 and 14. Movable plate 18 is affixed to telescopic members 12 and 14 such that it moves away from stationary plate 16 upon expansion of telescopic members 12 and 14 and such that it moves toward stationary plate 16 upon contraction of telescopic members 12 and 14 to perform snubbing operations. An intermediate plate 20 is secured between stationary plate 16 and movable plate 18. Intermediate plate 20 is also secured to telescopic members 12 and 14, such that intermediate plate 20 is movable between a first position between stationary plate 16 and movable plate 18 as shown in FIG. 2 and a second position withdrawn from between stationary plate 16 and movable plate 18 as shown in FIG. 3. Clamps 22 are used to secure intermediate plate 20, such that, when one clamp 22 is removed, the other may be used as a hinge to remove intermediate plate 20. Referring to FIG. 3, clamp 22 is supported vertically by an engagement profile on telescopic members 12 and 14. Movable plate 18 and intermediate plate 20 are designed to support slips (not shown) used in snubbing operations, while stationary plate 16 attached to, for example, a stripping head 24 as depicted, or other wellhead equipment, such as a blowout preventer, etc.

It will be understood that there may be other designs to allow intermediate plate 20 to be removably positioned between stationary plate 16 and movable plate 18. For example, there may be an attachment provided between stationary plate 16 and movable plate 18, or a combination of attachments. However, it has been found that the depicted embodiment is convenient as it allows intermediate plate 20 to be pivoted out of the way.

Operation:

Referring to FIG. 1, in operation, a tubing string (not shown) passes through the centre of plates 16, 18 and 20. In order to provide better access to the snubbing jack, such as for servicing requirements, the tubing string is moved out of the way, one of the clamps 22 is removed as shown in FIG. 2, and intermediate plate 20 is then pivoted out of the way to allow access to, in the example depicted, an RS stripping head 24 as shown in FIG. 3. In this example, the RS stripping head cap 26 (shown in FIGS. 1 and 2) may then be removed, to provide access to the sealing elements 28. As can be seen, the stationary plate 16 is secured to the neck of stripping head 26 by a multi-spiral retainer ring 30.

Advantages:

The design of snubbing jack 10 discussed above provides certain advantages. For example because intermediate plate 20 can be swung out of the way, and because the slips are carried by intermediate plate 20, it becomes easier to access certain elements in the wellhead equipment and/or the snubbing jack which require servicing.

In addition, while snubbing, the energy of the slips is applied to the bottom surface of intermediate plate 20 rather than on mounting bolts as is generally the case in other snubbing units. This reduces the chance of a thread failure, which could result in losing control of the tubing string.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A snubbing jack, comprising:

a first telescopic member and a second telescopic member;

a stationary plate affixed to the telescopic members;

a movable plate affixed to the telescopic members, the movable plate moving away from the stationary plate upon expansion of the telescopic member and moving toward the stationary plate upon contraction of the telescopic members; and an intermediate plate secured between the stationary plate and the movable plate, wherein the intermediate plate is movable between a first position between the stationary plate and the movable plate and a second position withdrawn from between the stationary plate and the movable plate.

2. The snubbing jack of claim 1, wherein the intermediate plate is secured to the telescopic members.

3. The snubbing jack of claim 1, wherein the movable plate and the intermediate plate carry slips.

* * * * *